United States Patent [19]

Kurt

[11] Patent Number: 4,512,417

[45] Date of Patent: Apr. 23, 1985

[54] HYDRAULIC RECIPROCATING DEVICE

[75] Inventor: Ewald H. Kurt, Phillipsburg, N.J.

[73] Assignee: Ingersoll-Rand Company, Woodcliff Lake, N.J.

[21] Appl. No.: 575,719

[22] Filed: Jan. 31, 1984

Related U.S. Application Data

[63] Continuation of Ser. No. 318,482, Nov. 5, 1981, abandoned.

[51] Int. Cl.[3] ..... E21C 7/00; F15B 21/02

[52] U.S. Cl. ..... 173/77; 173/75; 173/102; 173/135; 91/39; 91/165

[58] Field of Search ..... 91/165, 166, 39, 40, 91/50, 321, 235; 173/77, 75, 73, 102, 135

[56] References Cited

U.S. PATENT DOCUMENTS

| | | | |
|---|---|---|---|
| 1,126,943 | 2/1915 | Bayles | 91/235 |
| 1,414,224 | 4/1922 | Smith | 91/231 |
| 3,248,879 | 5/1966 | Natho | 91/166 |
| 3,800,664 | 4/1974 | Phillips | 91/165 |
| 3,925,985 | 12/1975 | Peterson | 91/165 |
| 4,084,646 | 4/1978 | Kurt | 173/137 |
| 4,103,591 | 8/1978 | Reiersdal | 91/39 |
| 4,284,147 | 8/1981 | Jenne | 91/321 |
| 4,295,411 | 10/1981 | Grantmyre | 91/165 |
| 4,317,406 | 3/1982 | Takahashi | 91/39 |

*Primary Examiner*—Paul E. Maslousky

*Attorney, Agent, or Firm*—R. J. Falkowski

[57] ABSTRACT

This invention pertains to a hydraulic reciprocating device having a housing and a piston in the housing. The piston has a first and second surface, and a means for intermittently communicating the first surface of the piston with a hydraulic pressure source. Also provided is a means for continuously communicating the second surface of the piston with pressurized fluid such as pneumatic fluid. The piston moves in a first direction when the hydraulic pressure source communicates with the first surface of the piston and the piston moves in a second direction when the hydraulic pressure source does not communicate with the first surface of the piston.

3 Claims, 2 Drawing Figures

HYDRAULIC RECIPROCATING DEVICE

This application is a continuation, of application Ser. No. 318,482, filed 11/5/81, now abandoned.

BACKGROUND OF THE INVENTION

1. Field of the Invention

This invention pertains to a hydraulic reciprocating device and more particularly to a hydraulic reciprocating drill, wherein, a piston continuously communicates with pressurized fluid on one side and intermittently communicates with a hydraulic pressure source on the other side.

2. Description of the Prior Art

Fluid reciprocating devices have found many uses, such as down-the-hole drilling. The fluid reciprocating devices include both pneumatic and hydraulic reciprocating devices. It is desired to obtain a hydraulic reciprocating device that reciprocates as fast as pneumatic reciprocating devices but uses less energy.

U.S. Pat. No. 2,876,742 to Sherrill relates to a variable speed fluid pressure actuated impact device, and more particularly, to a device of this character of a type wherein the impact member is rotatable. The device includes a rotating valve driven by an external motor.

U.S. Pat. No. 3,327,790 to Vincent et al relates to a fluid actuated tool for applying repeated percussive blows to a drill bit in the drilling of oil and gas wells. In particular, the patent concerns percussive motors for incorporting in drill strings causing drill bits to vibrate or oscillate axially at the same time they are being rotated for the drilling of such wells.

U.S. Pat. No. 2,402,300 to Shimer relates to fluid actuated mechanisms and systems. A rotary valve is employed to port fluid alternatively to opposite ends of a piston.

U.S. Pat. No. 3,484,204 to Caviness relates to a reactor for mixing viscous liquids under inert conditions and more particularly to a reactor having a plunger-type agitator for reacting highly viscous liquids under inert conditions in very small quantities. The device has a rotating valve which supplies pressure alternatively to the end of a rod.

U.S. Pat. No. 4,103,591 to Reiersdal relates to a device for hydraulically driven percussion hammer for activating a tool, especially intended as a drilling hammer. The device discloses a rotating valve that admits oil to a chamber and then vents the oil to a return line. The impact piston is driven upwards by this oil so that a surface on the top of the piston is charged with pressure and accumulated. When the bottom end of the piston is vented as the rotary valve turns, the piston is driven downwards by the accumulated pressure.

SUMMARY OF THE INVENTION

This invention pertains to a hydraulic reciprocating device having a housing. In the housing is a piston having a first surface and a second surface. A means for intermittently communicating with the first surface of the piston when hydraulic fluid is provided. Also provided is a means for continuously communicating the second surface of the piston with pressurized fluid such as air wherein the piston moves in a first direction when the hydraulic fluid communicates with the first surface of the piston and wherein the piston moves in a second direction with the hydraulic fluid does not communicate with the first surface of the piston.

DESCRIPTION OF THE PREFERRED EMBODIMENT

Figures 1, 2:
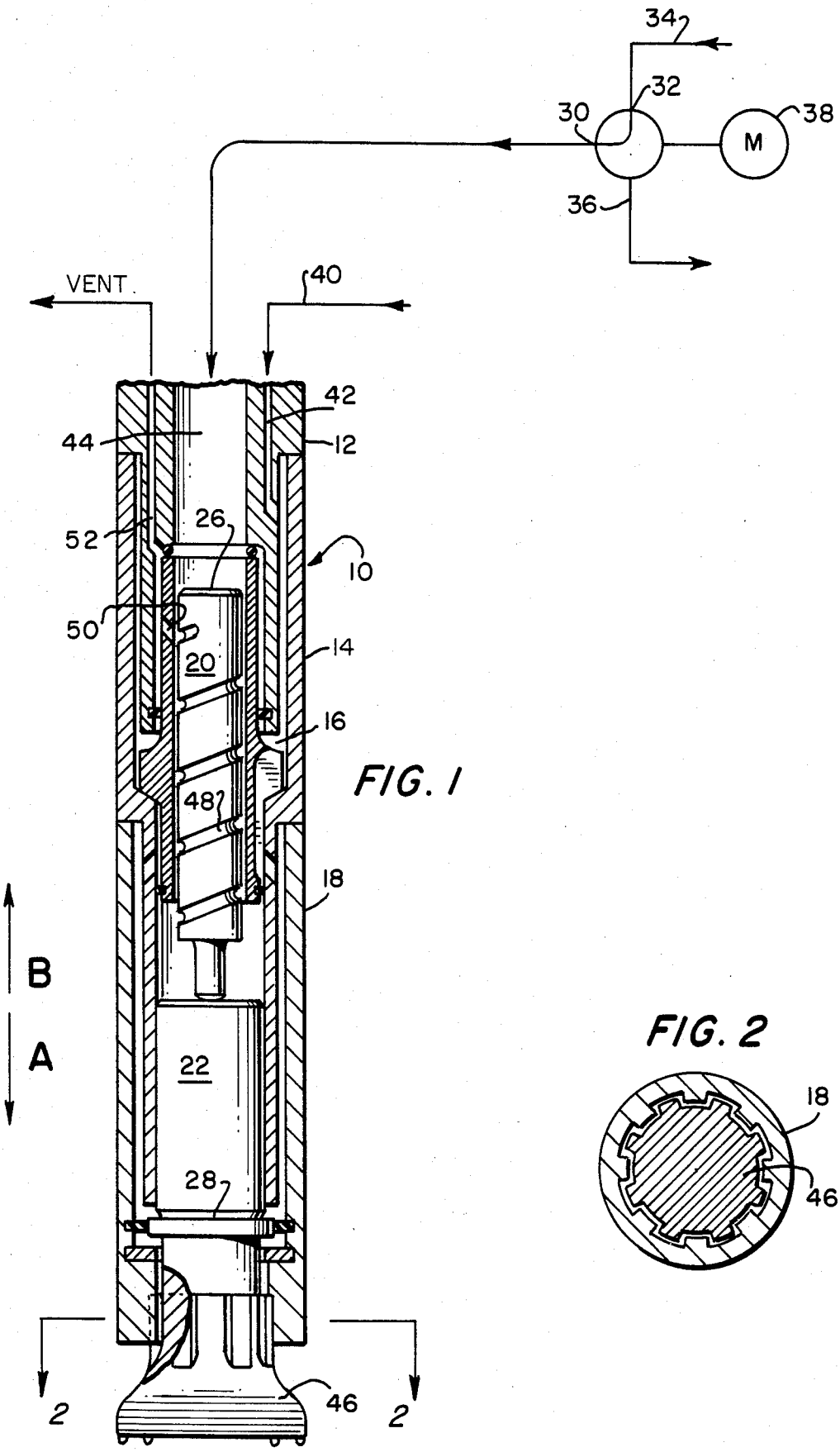
FIG. 1 is a schematic illustration of a hydraulic down-the-hole drill.
FIG. 2 is a schematic illustration of a cross section of a hydraulic down-the-hole drill.

Referring to FIG. 1, a hydraulic drill 10 is shown. The hydraulic drill 10 comprises a housing. The housing may be a single section or multiple section such as sections 12, 14, 16 and 18 as shown in FIG. 1. Located in the housing is a piston. The piston has a first surface and a second surface. In one embodiment of this invention, as shown in FIG. 1, the piston may be comprised of two separate members such as first piston member 20 and second piston 22. First piston 20 has a first surface 26 and second piston 22 has a second surface 28. A means for intermittently communicating the first surface of the piston with hydraulic fluid is provided. The means for intermittently communicating includes such means as a rotating valve 30 having a port 32 which alternately communicates with a hydraulic fluid supply 34 and a hydraulic fluid return 36. Rotating valve 30 may be rotated by conventional means such as a motor 38. A means is also provided for continuously communicating the second surface of the piston with pressurized fluid which includes pressurized gas such as for example pneumatic fluid. In FIG. 1 a pneumatic supply 40 is shown.

According to the embodiment of this invention as shown in FIG. 1, pneumatic supply 40 communicates with second surface 28 by means of passage 42 which extends through section 12, 14, 16 and 18. This tends to move the piston in a second direction shown as direction B. When valve 30 is positioned such that hydralic fluid is returned from passage 44 to the sump by means of hydraulic fluid return 36, the first and second pistons will move in direction B. As valve 30 rotates port 32 communicates with hydraulic fluid supply 34. Thus first surface 26 communicates with hydraulic supply 34 by means of passage 44. The communication is done in an intermittent manner. When hydraulic supply 34 communicates with first surface 26 the pressure of the hydraulic supply 34 times the surface area of first surface 26 is greater than the pressure of pneumatic supply 40 times the area of second surface 28 which causes the piston to move in a first direction shown as direction A. The device as shown in FIG. 1 has a percussive drill bit 46 attached to the hydraulic drill 10. As the piston moves in direction A it impacts bit 46 producing a percussive drilling affect. A suitable application of this device is down-the-hole drilling. Rotary movement is supplied to the percussive bit 46 by rotating the housing. The housing is rotated by conventional means known to those skilled in the art and is not shown. As shown in FIG. 2, the spline arrangement of the percussive bit 46 and the housing allows for the rotational and percussive movement of percussive bit 46.

In the embodiment shown in FIGS. 1 and 2 the piston has a two-piece construction with the space between the pistons vented. This eliminates any alignment problems associated with two piston sealing diameters. The venting of the pneumatic fluid occurs by means of the fluid passing between second piston 22 and section 18 towards first piston 20. The pneumatic fluid then passes around first piston 20 by means of spiral groove 48 to port 50. From port 50 the pneumatic fluid passes through passage 52 to vent.

When the device is employed as a percussive down-the-hole drill, pneumatic supply 40 may additionally be used as a cleaning fluid to purge chips from the hole which result from the drilling. This may be accomplished by continuous leakage of pneumatic supply 40 past second piston 22 or by intermittent blow-by wherein cleaning fluid is permitted into the hole by means of an exhaust tube as second piston 22 reciprocates. The details for utilizing cleaning fluid to purge chips from the hole are known to those skilled in the art such as those taught in U.S. Pat. No. 4,084,646 to Kurt. It is believed when small drills are employed the continuous leakage method is preferred but when large drills are used, the intermittent method is preferred.

I claim:

1. A hydraulic reciprocating device for a downhole drill comprising:

(a) a housing;

(b) a piston means in said housing, said piston means having a first operating surface and a second opposed operating surface;

(c) a means for alternately communicating said first surface of the piston means with a hydraulic fluid; supply and hydraulic fluid return (d) a means for continuously communicating said second surface of the piston means with pneumatic fluid wherein the piston means moves in a first impact direction when the hydraulic fluid supply communicates with the first surface of the piston and wherein the piston means moves in a second return direction when the hydraulic fluid return communicates with the first surface of the piston means; said piston having said first surface and a separate second piston having said second surface, and (e) a means for venting said pneumatic fluid whereby said pneumatic fluid also purges the drill hole for chip removal.

2. A hydraulic reciprocating device according to claim 1 wherein a percussive bit is attached to the device and wherein in the second surface of the piston means impacts the percussive bit as the piston means moves in a first direction.

3. A hydraulic reciprocating device according to claim 1 wherein the means for alternately communicating with said first surface of the piston means with hydraulic fluid is a rotating valve which causes said first surface of the piston means to communicate alternately with said hydraulic supply and with a hydraulic fluid return.

* * * * *